US008113279B2

(12) United States Patent
Lee et al.

(10) Patent No.: US 8,113,279 B2
(45) Date of Patent: Feb. 14, 2012

(54) APPARATUS AND METHOD FOR INSTANTANEOUSLY INJECTING TRACER FOR GROUNDWATER WELL

(75) Inventors: Bong Joo Lee, Daejeon (KR); Yong Cheol Kim, Daejeon (KR); Yong Je Kim, Daejeon (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 281 days.

(21) Appl. No.: 12/486,822

(22) Filed: Jun. 18, 2009

(65) Prior Publication Data

US 2010/0206558 A1 Aug. 19, 2010

(30) Foreign Application Priority Data

Feb. 13, 2009 (KR) ..... 10-2009-0012017

(51) Int. Cl.
*E21B 47/00* (2006.01)

(52) U.S. Cl. ..... 166/250.12; 166/90.1

(58) Field of Classification Search ..... None
See application file for complete search history.

(56) References Cited

U.S. PATENT DOCUMENTS 4,966,233 A * 10/1990 Blount et al. ..... 166/162
2009/0080979 A1 3/2009 Zehler

FOREIGN PATENT DOCUMENTS

JP 2005-172574 A 6/2005
WO WO-9407147 A1 3/1994

* cited by examiner

*Primary Examiner* — Zakiya W Bates
(74) *Attorney, Agent, or Firm* — Jenkins, Wilson, Taylor & Hunt, P.A.

(57) ABSTRACT

There is provided an apparatus for injecting a tracer within a groundwater observation well, which is capable of sequentially performing a tracer test by depth by injecting the tracer to a predetermined depth within the groundwater observation well. More particularly, the present invention relates to an apparatus and method for instantaneously injecting a tracer to a groundwater well, whereby opening and closing of a container receiving the tracer is controlled by using a pneumatic cylinder and the tracer on the ground is supplied to the container, so that the tracer is repeatedly carried and injected to a specific depth in a well.

10 Claims, 8 Drawing Sheets

APPARATUS AND METHOD FOR INSTANTANEOUSLY INJECTING TRACER FOR GROUNDWATER WELL

CROSS-REFERENCE TO RELATED APPLICATION

This application claims the benefit of Korean Patent Application No. 10-2009-0012017, filed on Feb. 13, 2009, in the Korean Intellectual Property Office, the disclosure of which is incorporated herein in its entirety by reference.

BACKGROUND OF THE INVENTION

1. Field of the Invention

The present invention relates to an apparatus and method for sequentially performing instantaneous injection of a tracer by changing a depth within a groundwater observation well.

2. Description of the Related Art

A tracer test is a method to know the properties of hydraulic connectivity and hydraulic dispersion of a medium through the reaction morphology to a chemical impact which is in higher concentration than a background concentration. Steps of selecting a tracer, making a solution, injecting the tracer and observing/analyzing concentration change are performed to complete a tracer test. The point dilution technique is a kind of the trace test. It aims to relate the observed dilution of a tracer, introduced into a groundwater observation well, to groundwater flow.

Generally, a point dilution test is carried out after a specific section within a well is isolated by a packer and a tracer is injected into the section between the upper packer and the lower packer through a tracer injection pipe. The packer installed in the specific section in the well aims to prevent a vertical flow of groundwater in the specific section.

However, when the packer is used, a lot of equipment is increasingly needed to perform the tracer test and a lot of time and work are needed to move/install/disjoint the packer in the well. In the case where there is no vertical flow of the groundwater in the well or the vertical flow is insignificant, it is possible to perform the tracer test by injecting the tracer without installing the packer. However, in this case, since it is difficult to continue carrying the tracer, the tracer test is limited to one.

SUMMARY OF THE INVENTION

The present invention is to develop a technique capable of sequentially supplying a tracer to a container of an apparatus for injecting the tracer and instantaneously injecting the supplied tracer to a specific depth in a well. For this purpose, it is an object of the present invention to provide an apparatus which is capable of supplying a tracer to a container of an apparatus for injecting the tracer, instantaneously injecting the tracer by controlling opening and closing of the container, and repeatedly performing these processes. The development of this apparatus has the advantage of making it possible to sequentially perform a tracer test by moving test equipment to a different depth within the well, without pulling up the test equipment after the tracer test is performed at a specific depth in the well. Therefore, time and work required for the tracer test are minimized.

The above and other objects and advantages of the present invention will be described below and become more apparent by describing in detail exemplary embodiments. The objects and advantages of the present invention are realized by the means disclosed in the claims and by the combination of the means.

According to an aspect of the present invention, there is provided an apparatus for instantaneously injecting a tracer to a specific depth in a groundwater observation well, comprising: a bi-directional piston with one end receiving a piston shaft moving up/down; an upper plate connected to a lower end of the bi-directional piston; a lower plate spaced apart from the upper plate at a predetermined distance to form a space and connected to the upper plate through a number of connection rods; a container with one end fixedly connected to the piston shaft within the space and the other end being opened and hollow; a tracer injection rod fixedly installed at the lower plate in a perpendicular direction to be operatively connected each other, and having one end forming a piston inserted into the other end of the container; and a tracer injection pipe with both of upper and lower ends being opened, the upper end fixed to the upper plate and the lower end operatively connected to the lower plate.

Further, the container comprises a number of guide rings formed to protrude from an outer circumferential surface of the container, to receive a number of the connection rods and to guide the container in a movement direction upon moving up/down.

Further, the apparatus comprises a tracer tank for storing the tracer; an injection line with one end operatively connected to the tracer tank and the other end operatively connected to the tracer injection pipe; and a driving pump installed in the middle of the injection line, to pressurized the tracer to the tracer injection pipe so that the tracer is supplied to the tracer injection pipe.

Further, the tracer injection rod is hollow and comprises a number of release openings formed by boring on an outer circumferential surface of the tracer injection rod, so that the tracer supplied to the tracer injection pipe is released through the release openings.

Further, when the piston shaft is moved down by the bi-directional piston, the container receives the whole of the tracer injection rod lengthwise and the other opened end of the container is closely secured to the lower plate, and when the piston shaft is moved up by the bi-directional piston, the container moves up together with the piston shaft so that only the piston of the tracer injection rod is received in the other opened end of the container.

Further, the lower plate comprises a connection groove formed on the top of the lower plate to correspond and fit with the other opened end of the container; and a packing ring inserted in the connection groove, to maintain an airtight state at a connection region when the container moves down to be fitted into the connection groove.

Further, the piston comprises an operative connection opening formed by boring and the container comprises an outlet opening formed on the top of the container, so that the pressure inside and outside the container is equally/consistently maintained even after the tracer is injected.

Further, the apparatus comprises: a sensor attached to the outer circumferential surface of the tracer injection rod lengthwise, to check the concentration of the tracer released around the tracer injection rod so as to be compared with the initial concentration of the tracer being injected.

Further, the bi-directional piston comprises a fixing ring on its top so that a fixing wire is connected to the fixing ring, and the fixing wire is controlled by a winch installed on a ground so that the apparatus is moved down to a desired target depth to be measured within an groundwater observation well.

Further, the bi-directional piston has an upper end connected to one end of a first supply line and the lower end connected to one end of a second supply line, and the other ends of the first and second supply lines are connected to a pneumatic supply tank installed on the ground.

Further, each of the upper and lower plates comprises a number of plates, auxiliary members are connected between a number of the upper plates and between a number of the lower plates, respectively, wherein the auxiliary member has a relatively greater diameter than those of the upper and lower plates and a number of the auxiliary members are face-joined in one body and include a number of cut parts formed at the equal intervals, along the circumference.

According to another aspect of the present invention, there is provided a method for instantaneously injecting a tracer for a groundwater well, comprising: step (S100) of dropping an apparatus for instantaneously injecting the tracer for the groundwater well to an operator's desired depth to be measured within an groundwater observation well; step (S200) of moving down a container to receive the whole of a tracer injection rod by supplying pressure to a first supply line of a bi-directional piston; step (S300) of filling the tracer in the container by supplying the tracer to a tracer injection pipe and releasing the supplied tracer through an release opening of the tracer injection rod; step (S400) of releasing the tracer outside by moving up the container by supplying the pressure to a second supply line of the bi-directional piston; step (S500) of checking, for a predetermined time, the concentration of the released tracer, using a sensor positioned on an outer circumferential surface of the tracer injection rod; and step (S600) of determining whether to repeat measurement at the same depth within the groundwater observation well or to re-start measurement by changing a depth.

BRIEF DESCRIPTION OF THE DRAWINGS

The above and other features and advantages of the present invention will become more apparent by describing in detail exemplary embodiments thereof with reference to the attached drawings in which.

BRIEF DESCRIPTION OF REFERENCE NUMBERS OF MAJOR ELEMENTS

Figure 1:
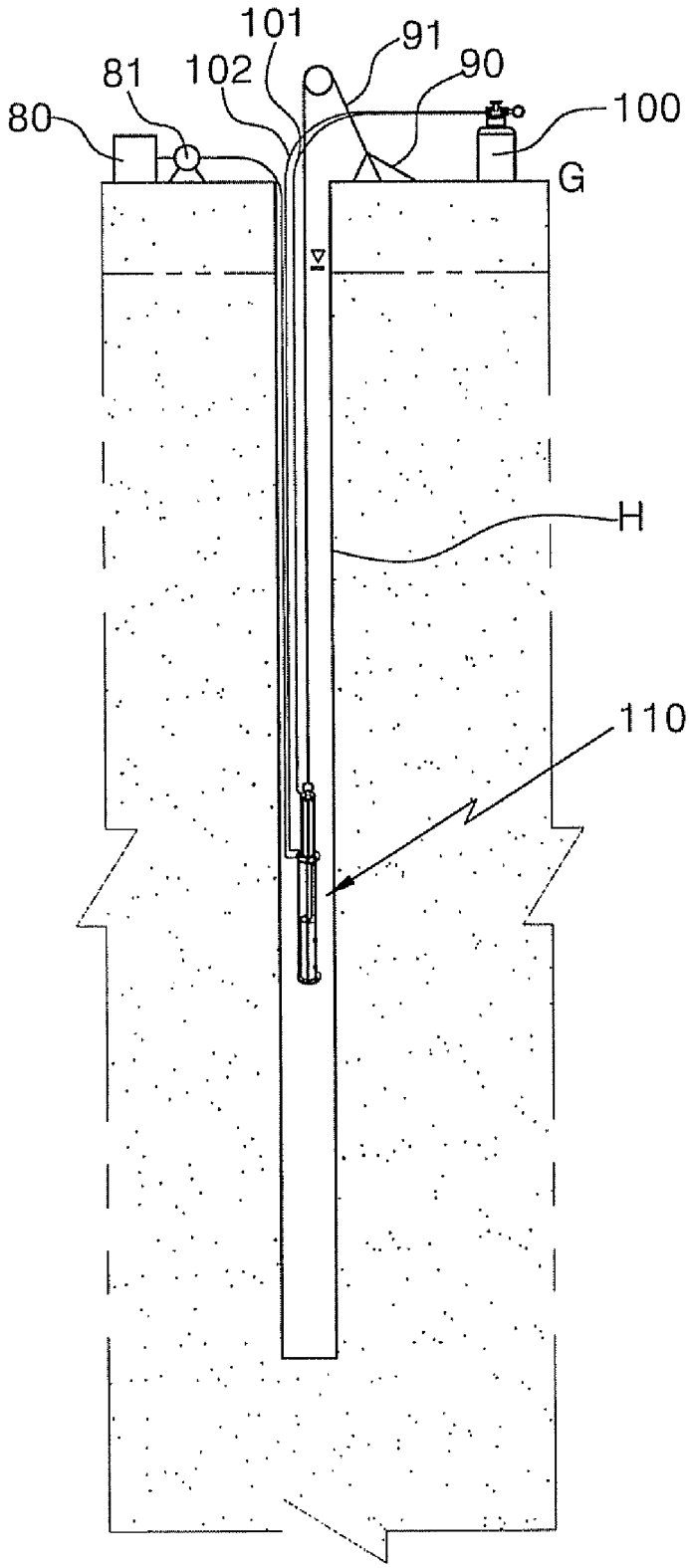
FIG. 1 is a front view of an apparatus for injecting a tracer being applied according to an exemplary embodiment of the present invention.

| | |
|---|---|
| 10: bi-directional piston | 11: piston shaft |
| 12: first inlet opening | 13: second inlet opening |
| 14: fixing ring | 20: upper plate |
| 21: through-aperture | 22: connection rod |
| 23: space | 24: auxiliary member |
| 25: cutting part | 30: lower plate |
| 31: connection groove | 32: packing ring |
| 40: container | 41: guide ring |
| 42: outlet opening | 50: tracer injection rod |
| 51: piston | 52: release opening |
| 53: operative connection opening | 60: tracer injection pipe |
| 70: sensor | 80: tracer tank |
| 81: driving pump | 82: injection line |
| 90: winch | 91: fixing wire |
| 100: pneumatic supply tank | 101: first supply line |
| 102: second supply line | |

DETAILED DESCRIPTION OF THE INVENTION

Before exemplary embodiments of the present invention are described in detail, it will be understood that, detailed constitution and arrangements of elements described in the detailed description or illustrated in the drawings should not be construed as limiting the application of the invention. The invention may be embodied in many alternate forms and performed in various methods. The terms or words to describe the direction of an apparatus or element (for example, "front", "back", "up", "down", "top", "bottom", "left", "right" and "lateral", among others) are used to simplify the description of the invention. It will be, therefore, understood that these terms do not mean that the relevant apparatus or element shall be only in the specific direction.

The present invention will now be described more fully hereinafter with reference to the accompanying drawings, in which preferred embodiments of the invention are shown. It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the invention, based on the principle that an inventor may properly define the meaning of the words or terms to best explain the invention.

Accordingly, while example embodiments of the present invention are capable of various modifications and alternative forms, embodiments of the present invention are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention. It will be also understood that, the terms, such as "first" or "second", are used for clarification in the detailed description and claims and therefore, the terms should not be construed as indicating any relative importance, intent or meaning.

As used herein, the singular forms "a", "an" and "the" are intended to include the plural forms as well, unless the context clearly indicates otherwise.

An apparatus and method for instantaneously injecting a tracer for a groundwater well according to an exemplary embodiment of the present invention will be described, in detail, with reference to FIGS. 1 through 9.

As illustrated, the apparatus for instantaneously injecting a tracer for a groundwater well according to the present invention comprises: a bi-directional piston 10, an upper plate 20, a lower plate 30, a container 40, a tracer injection rod 50 and a tracer injection pipe 60.

The bi-directional piston 10 includes a piston shaft 11. The piston shaft 11 includes one end installed at an inner bottom of the bi-directional piston 10 and moves bi-directionally, up and down. The other end of the piston shaft 11, the one end of which is installed at the inner bottom of the bi-directional piston 10, is fixedly connected to the container 40. A first inlet opening 12 and a second inlet opening 13 through which pressure is injected are each formed on an upper end and a lower end of an outer circumferential surface of the bi-directional piston 10. A fixing ring 14 connecting a fixing wire 91 is formed on the top of the bi-directional piston 10. The fixing wire 91 is movable up and down by a winch 90 installed on the ground G, to position an apparatus 110 for injecting a tracer within a groundwater observation well H.

The first inlet opening 12 formed at the upper position is connected to one end of a first supply line 101, and the second inlet opening 13 formed at the lower position is connected to one end of a second supply line 102. The other end of each of the first and second supply lines 101 and 102 is connected to a pneumatic supply tank 100 installed on the ground G, to receive the pressure supplied from the pneumatic supply tank 100.

That is, when the pressure is supplied to an upper part of the bi-directional piston 10 through the first inlet opening 12, the piston shaft 11 with one end installed at the inner bottom of the bi-directional piston 10 is moved down. When the pressure is supplied to a lower part of the bi-directional piston 10 through the second inlet opening 13, the piston shaft 11 is moved up.

The upper plate 20 is installed at the bottom of the bi-directional piston 10. The upper plate 20 includes a through-aperture 21 to receive the piston shaft 11 with the one end installed at the inner bottom of the bi-directional piston 10.

A number of the upper plates 20 are positioned at the upper position so as to be face-joined, and a number of the lower plates 30 (to be described later) are positioned at the lower position so as to be face-joined.

An auxiliary member 24 is connected between the adjacent upper plates 20. The auxiliary member 24 has a relatively greater diameter than that of the upper plate 20. The auxiliary member 24 is formed of a number of cutting parts 25 which are cut at the equal distance, along the circumference. The cutting parts 25 are cut to a predetermined length from an outer circumference toward the centre. A number of the auxiliary members 24 are connected one another so as to be in one body. The cutting parts 25 formed in each auxiliary member 24 are cut at different positions so as not to be operatively connected one another.

The auxiliary members 24 are connected to a plurality of the upper plates 20 and to a plurality of the lower plates 30. When the apparatus for injecting a tracer is moved down within the groundwater observation well H and is positioned at a desired depth, the auxiliary members 24 minimize upward/downward flows of groundwater, to seal a space between the upper plates 20 and the lower plates 30 so that a tracer released between the upper plates 20 and the lower plates 30 may not be influenced by the groundwater flowing in a vertical direction. Further, the auxiliary members 24 come into contact with a wall of the groundwater observation well H, to make the apparatus for injecting a tracer so as to be positioned at the centre of the groundwater observation well H. The each cutting part 25 formed in a number of the auxiliary members 24 in accordance with the diameter of the groundwater observation well H is bent selectively upward or downward, to come into contact with an inner circumference of the groundwater observation well H.

Further, the auxiliary members 24 which are face-joined to be in one body are cut at different positions so that the cutting parts 25 formed in the auxiliary members 24 should not be operatively connected one another, to prevent the groundwater from flowing upward/downward through the cutting parts 25. The cutting parts 25 are cut to the predetermined length from the circumference of the auxiliary members 24 toward the centre thereof. That is, the cutting parts 25 are cut from the circumference of the auxiliary members 24 within a length so as not to be in contact with the upper plates 20/the lower plates 30, thereby preventing the uncut portions of the auxiliary members 24 in contact with the upper plates 20/the lower plates 30 from being easily broken.

The lower plate 30 is positioned under the upper plate 20. The lower plate 30 is connected to the upper plate 20 by a number of connection rods 22 each having a predetermined length. Accordingly, a space 23 is formed between the upper plate 20 and the lower plate 30. The piston shaft 11 and the container 40 (to be described later) connected to the piston shaft 11 move up/down within the space 23.

The lower plate 30 is hollow to be operatively connected to the tracer injection rod 50.

A connection groove 31 in a ring shape is formed on the top of the lower plate 30. The connection groove 31 contacts with and fits to the other end of the container 40 (to be described later). A packing ring 32 has a shape corresponding to that of the connection groove 31 and is fixedly inserted into the connection groove 31.

The container 40 is fixedly connected to the other end of the piston shaft 11 moving up/down in a length direction of the bi-directional piston 10. A number of outlet openings 42 are formed on one end (the top) of the container 40 fixed to the other end of the piston shaft 11. The outlet openings 42 are operatively connected. The other end of the container 40 is open. The container 40 has a cylindrical shape being hollow. Accordingly, since one end of the container 40 is fixed to the piston shaft 11, when the pressure is injected into the bi-directional piston 10 and the piston shaft 11 moves up/down, the container 40 moves up/down in the same manner that the piston shaft 11 moves up/down.

In other words, the piston shaft 11 and the container 40 are move up/down together within the space 23. When the container 40 moves down by the pressure supplied to the first inlet opening 12, the other end of the container 40, which is open, closely comes into contact with the top of the lower plate 30. Then, the other end of the container 40 which is open and securely fitted into the connection groove 31 formed on the top of the lower plate 30, and the airtight state between the connection groove 31 and the other end of the container 40 is maintained by the packing ring 32 positioned within the connection groove 31.

A number of guide rings 41 are formed on the outer circumference surface of the container 40 so as to protrude in the direction corresponding to a number of the connection rods 22. Accordingly, each of the connection rods 22 is inserted into the guide rings 41, to guide the container 40 to move up/down in the vertical direction when the piston shaft 11 moves up/down.

The tracer injection pipe 60 has both ends being open and is in a pipe shape being hollow. One end of the tracer injection pipe 60 is fixed to the upper plate 20, and the other end of the tracer injection pipe 60 is connected to the lower plate 30 so as to pass through the lower plate 30. The one end of the tracer injection pipe 60 fixed to the upper plate 20 is connected to an injection line 82. The injection line 82 is connected to a tracer tank 80 installed on the ground G. Therefore, the injection line 82 supplies the tracer stored in the tracer tank 80 to the tracer injection rod 50 through the tracer injection pipe 60. Then, a driving pump 81 is installed on the injection line 82, so that the tracer is pressurized and supplied by the driving pump 81.

That is, when the tracer is supplied through the tracer injection pipe 60, the supplied tracer moves to the hollow lower plate 30 and flows to the tracer injection rod 50 (to be described later).

The tracer injection rod 50 formed on the centre of the lower plate 30 is extended upward in a perpendicular direction. The tracer injection rod 50 has a pipe shape being hollow. One end of the tracer injection rod 50 connected to the lower plate 30 is open to be operatively connected to the lower plate 30. A disc shaped piston 51 like the piston shaft 11 is formed on an upper end of the tracer injection rod 50. The piston 51 has a smaller diameter than the inner diameter of the container 40, to enter the container 40. The piston 51 includes an operative connection opening 53 in a small size, so that the pressure inside and outside the container 40 is equal and some of the pressurized and injected tracer is released through the outlet openings 42 and the operative connection opening 53 outside the container, making it easy to inject the tracer into the container 40.

In other words, the tracer injection rod 50 includes the upper end forming the piston 51 and the lower end operatively and fixedly connected to the top of the lower plate 30. When the container 40 moves up by the piston shaft 11, the piston 51 of the tracer injection rod 50 is entered, at a predetermined length, in the other opened end of the container 40. When the container 40 moves down by the piston shaft 11, the container 40 allows the tracer injection rod 50 forming the piston 51 on its upper end to enter inside lengthwise so that the other opened end of the container 40 is fit into the connection groove 31 of the lower plate 30.

Further, the tracer injection rod 50 includes a number of release openings 52 which are formed by boring and spaced apart at equal intervals, lengthwise. When the container 40 moves down to receive the entire of the tracer injection rod 50, the tracer supplied form the tracer tank 80 and sequentially passing through the tracer injection pipe 50 and the lower plate 30 flows in the length direction of the tracer injection rod 50 and is released through a number of the release openings 52 bored on the outer circumferential surface of the tracer injection rod 50, to fill inside the container 40.

Then, the groundwater and some of the tracer injected into the container 40 through a number of the outlet openings 42 bored on the top of the container 40 is released outside the container 40. When the tracer is sequentially injected into the container 40, the groundwater inside the container 40 is replaced with the tracer.

When the injection of the tracer into the container 40 is completed, it needs to wait for a predetermined time until a solution of the tracer being released outside the container upon the injection of the tracer disappears. Subsequently, when the pressure is supplied through the second inlet opening 13 to move the container 40 up for a moment, the tracer is released around the tracer injection rod 50.

Further, a sensor 70 is fixedly installed about the outer circumference of the tracer injection rod 50 lengthwise, to record a change in concentration of the tracer for a predetermined time when the container 40 moves up and the tracer is released.

In other words, when the groundwater flows in a horizontal direction at a depth within the well H where an operator releases the tracer for her/his desired measurement, the tracer not only diffuses by the Brown Movement but also is transferred, along the flow direction of the groundwater. Consequently, the concentration of the tracer being earlier released is low due to the diffusion and advection. When the groundwater does not flow but stays static, the concentration of the tracer is diluted by the diffusion only. Since the diffusion changed concentration by the Brown Movement is very small in size, compared to the advection, it may be ignored. Comparing these factors, the groundwater flow is considered by the advection characteristics of the tracer in the depth within the groundwater observation well H.

Below, a method for injecting a tracer, using the apparatus for injecting a tracer having the same constitution and structures according to the preferred embodiment as described above, will be described.

Figure 2:
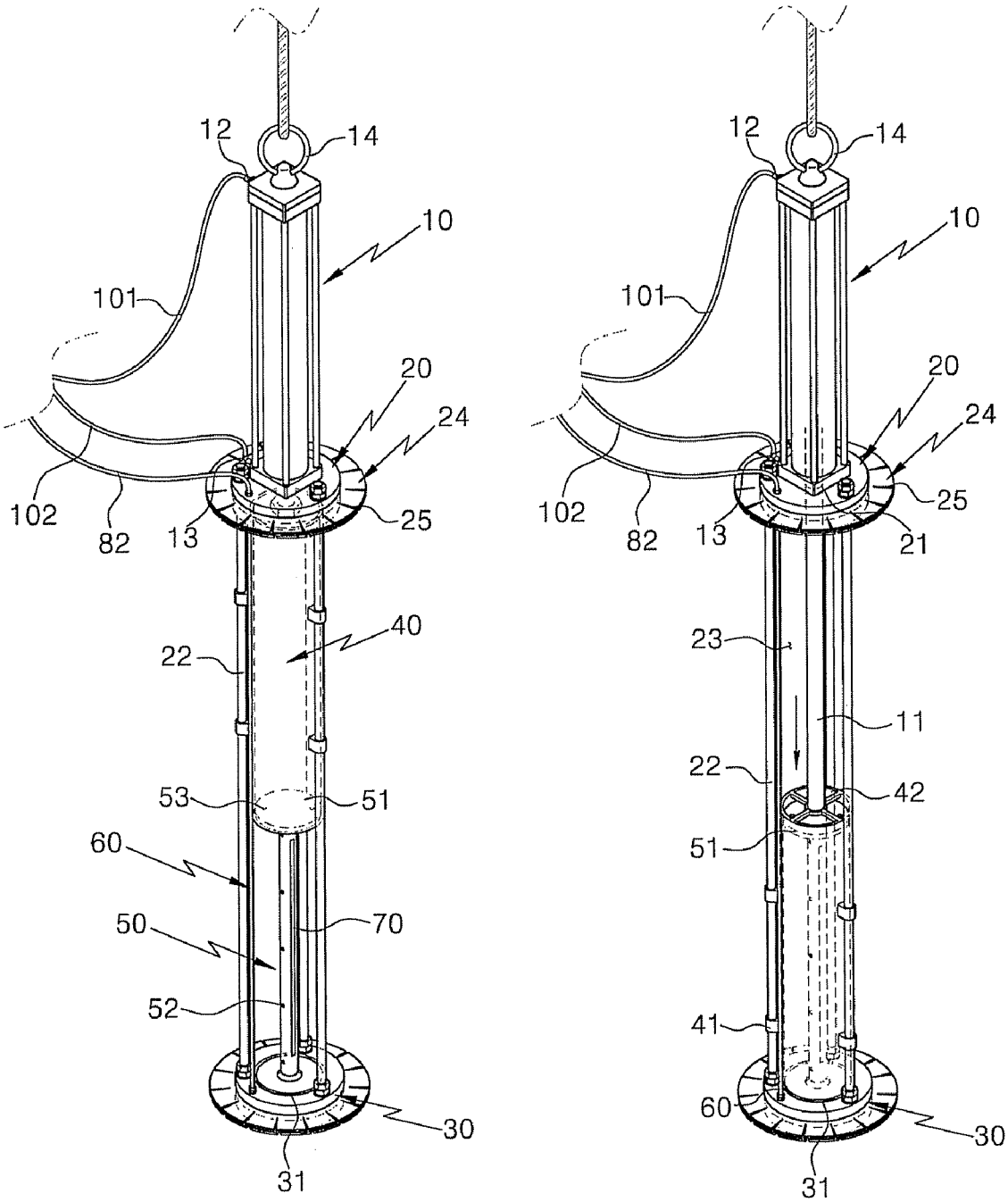
FIG. 2 is a front perspective view of the apparatus of FIG. 1 before and after a container moves up/down.
Figure 3:
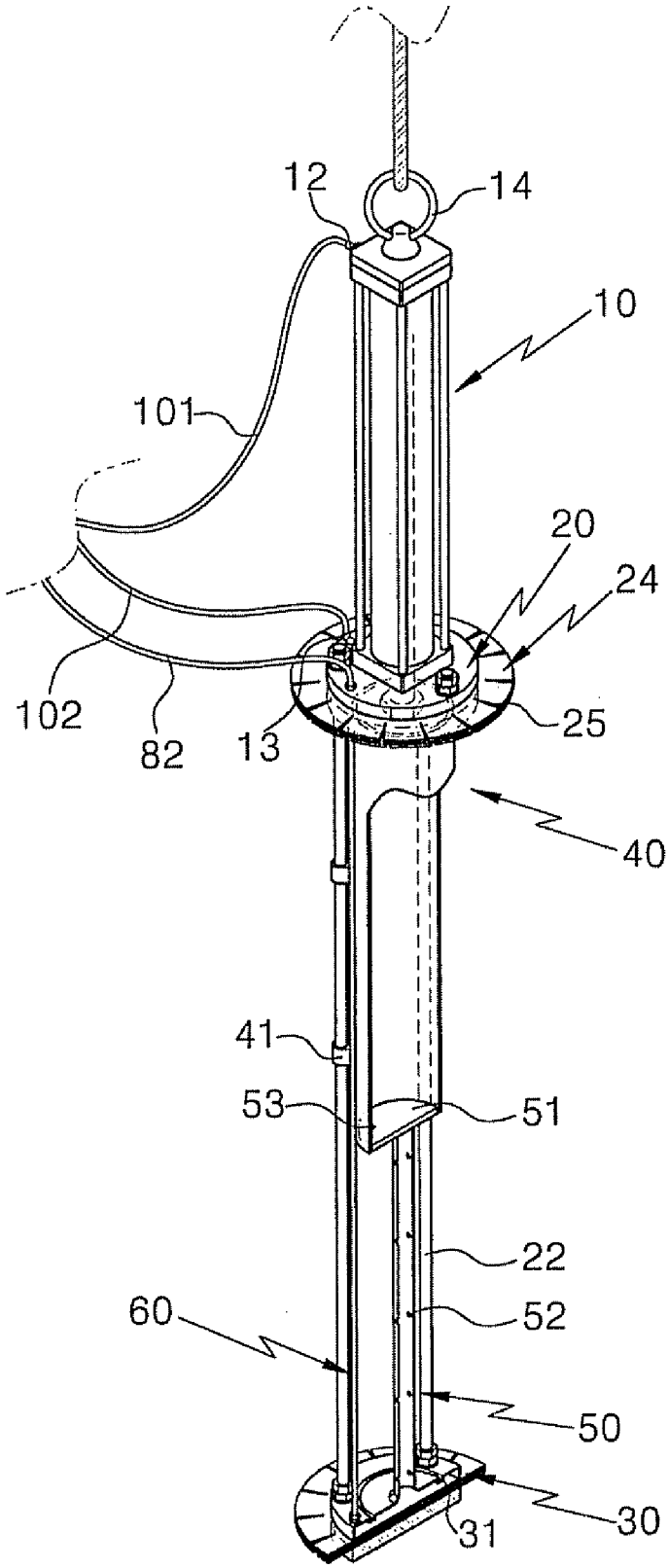
FIG. 3 is a perspective view to explain an operation of the apparatus of FIG. 1 before it is dropped to a target depth.

1. As illustrated in FIG. 2 or FIG. 3, the winch 90 is controlled to adjust a length of the fixing wire 91, to descend the apparatus for injecting a tracer at the depth within the groundwater observation well H as the operator wants to measure. At this time, the container 40 is positioned at the upper position of the space 23 so that the top of the container 40 contacts with the bottom of the upper plate 20 (Step S100).

Figure 4:
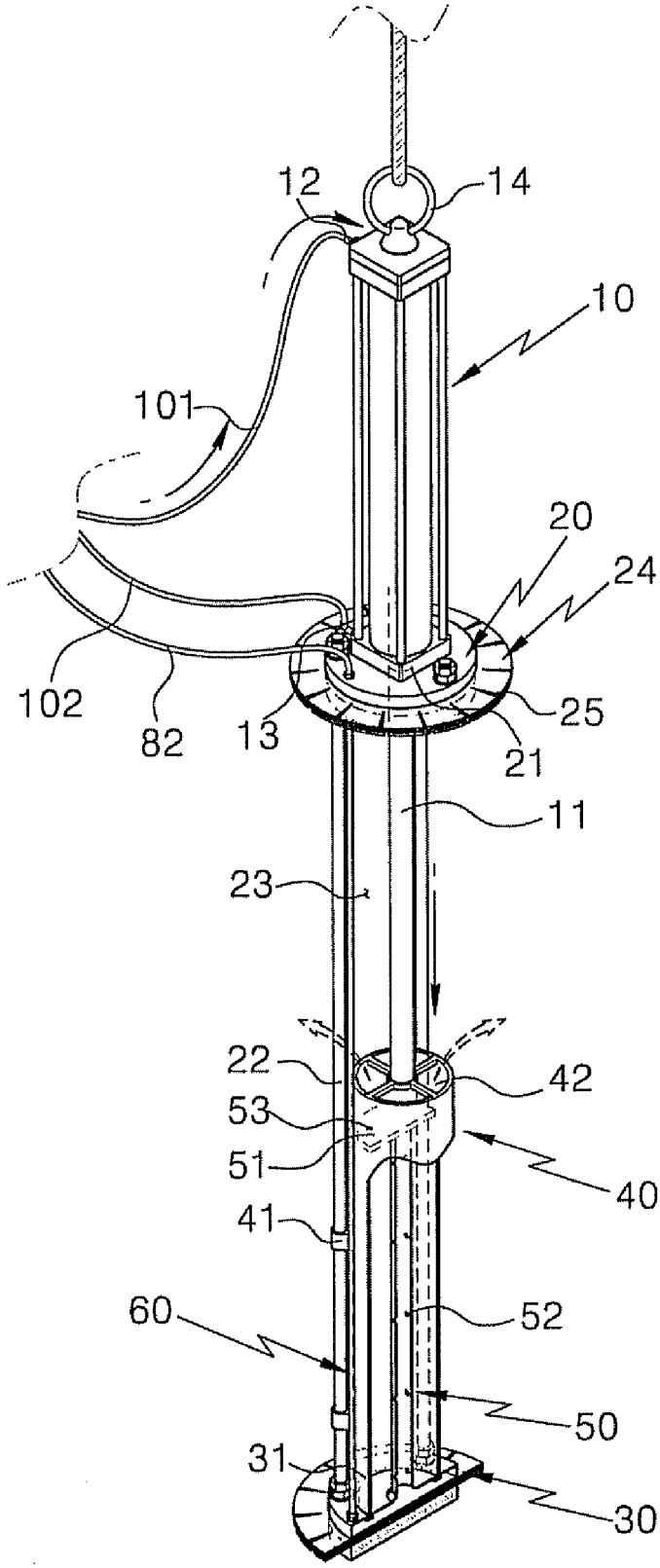
FIG. 4 is a perspective view to explain a step of moving down the container after the apparatus of FIG. 1 is dropped to the target depth.

2. Following Step S100, when the apparatus for injecting a tracer is positioned at the desired depth, as illustrated in FIG. 4 the pressure is supplied through the first inlet opening 12 so that the piston shaft 11 moves down. As the piston shaft 11 moves down, the container 40 moves down, so that the tracer injection rod 50 enters inside the container 40 lengthwise and the opened lower end of the container 40 is closely fixed to the lower plate 30 (Step S200).

Figure 5:
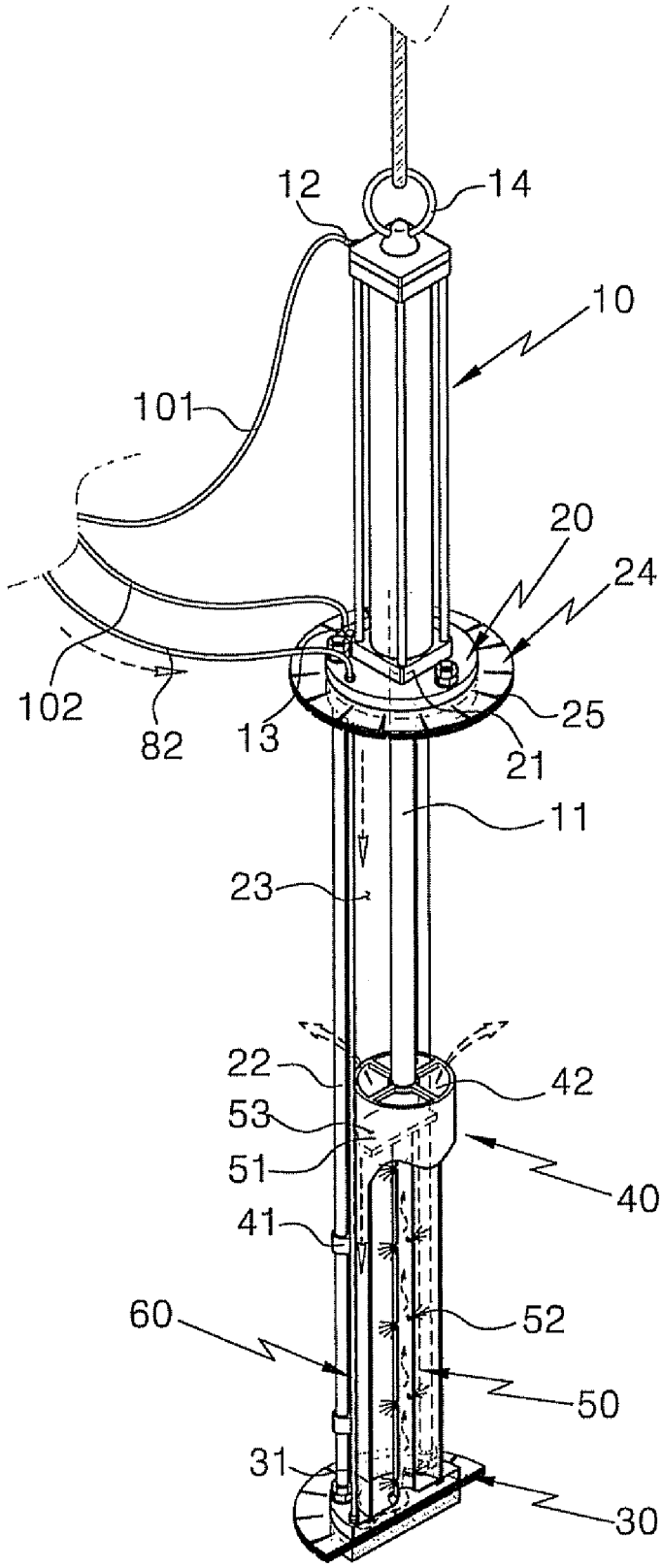
FIG. 5 is a perspective view to explain a step of supplying a tracer into the container.

3. Following Step S200, as illustrated in FIG. 5, the tracer is supplied to the injection line 82 through the tracer tank 80. After the tracer sequentially flows to the tracer injection pipe 60, the lower plate 30 and the tracer injection rod 50, it is released through the release openings 52 bored on the outer circumference of the tracer injection rod 50, to flow around the tracer injection rod 50, that is, into the container 40. The existing groundwater and some of the newly introduced tracer solution are discharged through the small operative connection opening 53 formed on the tope of the container 40, so that the groundwater inside the container 40 is replaced with the tracer solution (Step S300).

Figure 6:
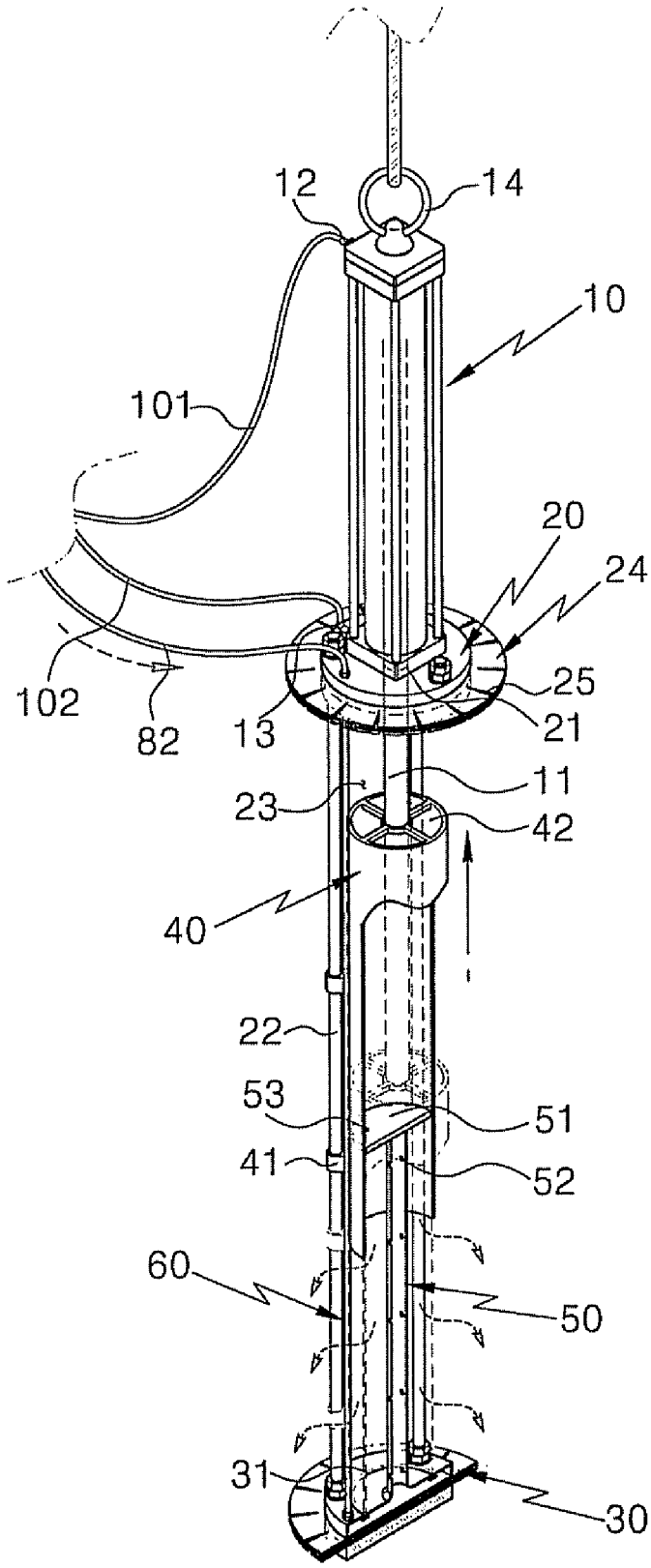
FIG. 6 is a perspective view to explain a step of releasing the tracer around the target depth by moving up the container.
Figure 7:
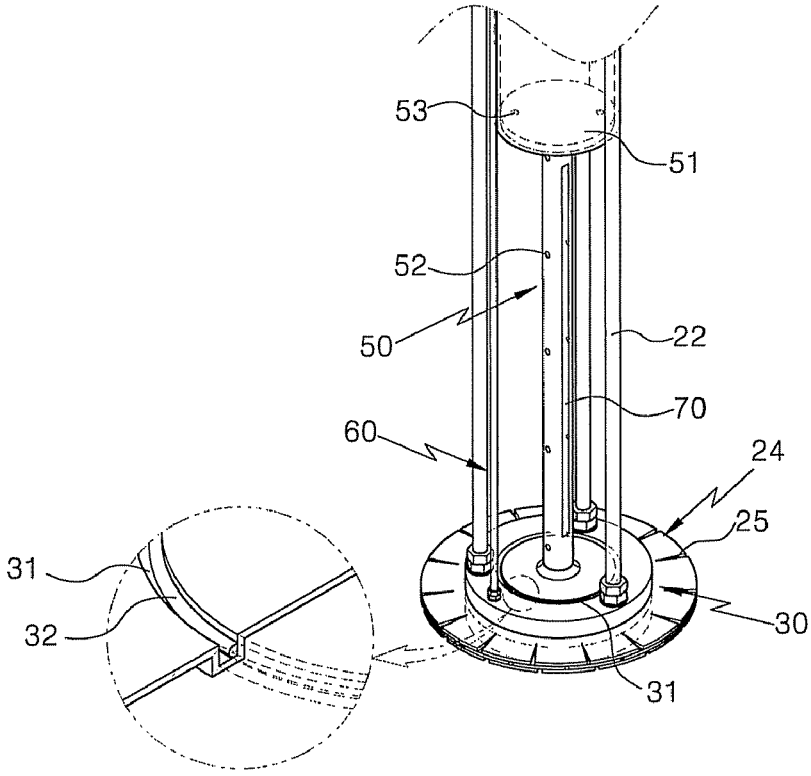
FIG. 7 is a perspective view to explain a tracer injection rod.

4. Following Step S300, after waiting for a given time until some of the tracer solution discharged outside the container 40 disappears, as illustrated in FIG. 6 the pressure is supplied to the second inlet opening 13 of the bi-directional piston 10, so that the piston shaft 11 enters into the bi-directional piston 10 and accordingly the container 40 also moves up instantly by the piston shaft 11 moved up. Then, the tracer filled around the tracer injection rod 50 or in the container 40 is released into the groundwater observation well H (Step S400).

Figure 8:
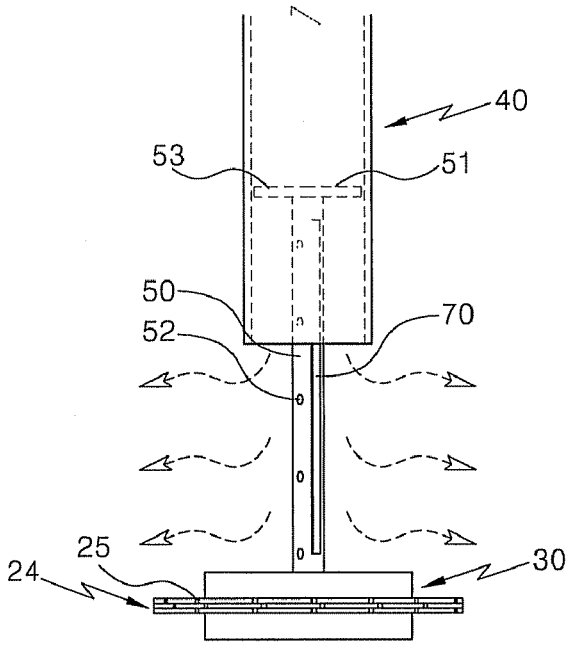
FIG. 8 is a perspective view to explain a step of measuring the concentration of the tracer released by the apparatus of FIG. 1.
Figure 9:
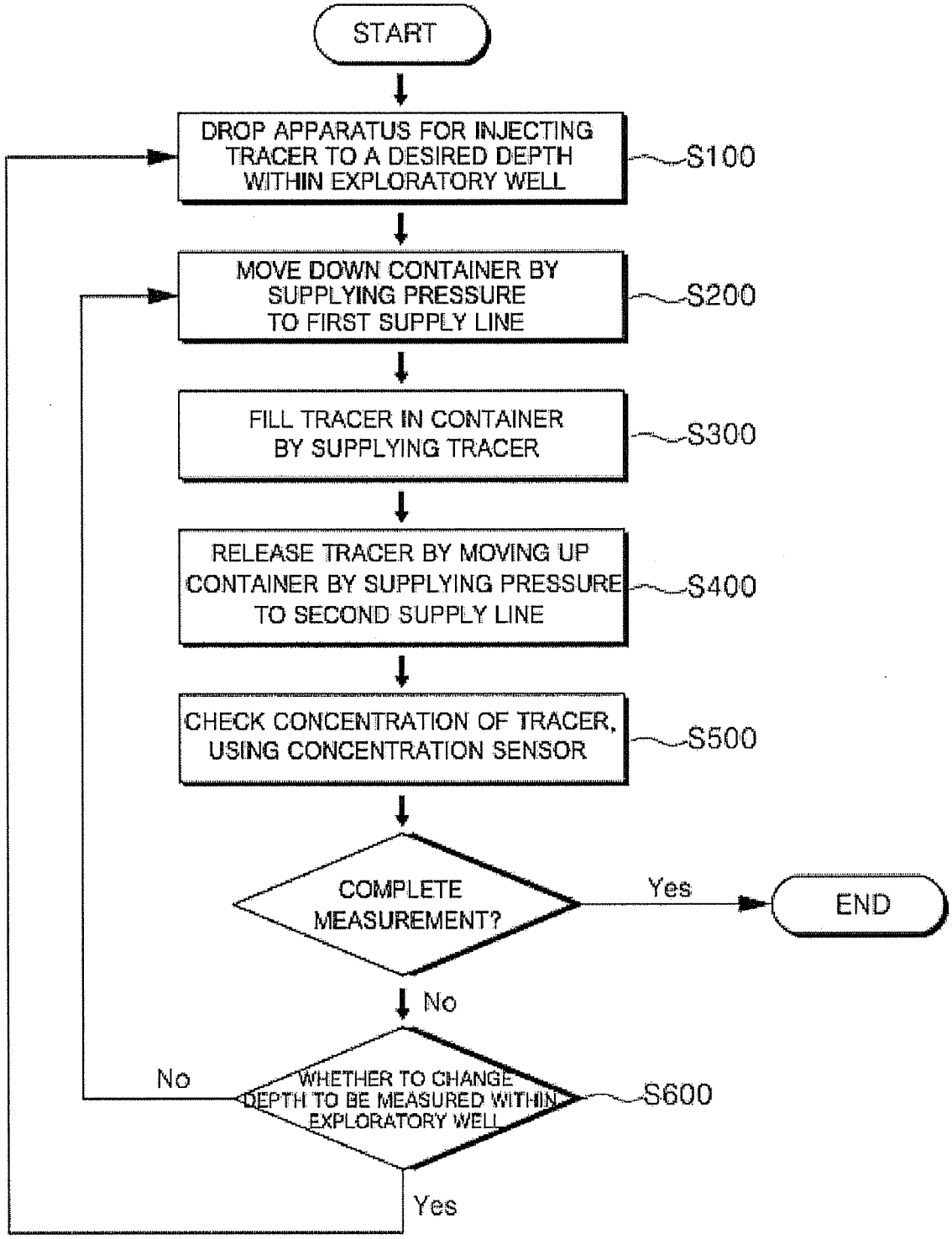
FIG. 9 is a flow chart of a method for injecting a tracer using the apparatus of FIG. 1.

5. Following Step S400, as illustrated in FIG. 8, a change in concentration of the tracer released into the groundwater observation well H is recorded by using the sensor 70 fixedly installed on the outer circumference of the tracer injection rod 50.

As described above, the tracer is released by performing sequentially the steps S100 through S500. Then, when the operator wants to repeat measurement at a particular depth, the steps S200 to S500 need to be sequentially performed. When the operator wants to perform measurement at a different depth after completing the measurement at the particular depth, (s)he may move the apparatus for injecting a tracer and repeatedly perform the steps (S100 through S500) sequentially (S600).

As described above, in the apparatus for instantaneously injecting a tracer to a groundwater well according to the present invention, it is possible to sequentially supply the tracer to the container of the apparatus, to instantaneously injecting the supplied tracer to a specific depth within the well and to repeat these processes. Furthermore, it enables to sequentially perform a tracer test at another depth within the groundwater observation well where a user wants to measure without moving the equipment.

The present invention is to develop a technique capable of sequentially supplying a tracer to a container of an apparatus for injecting the tracer and instantaneously injecting the supplied tracer to a specific depth in a well. For this purpose, it is an object of the present invention to provide an apparatus which is capable of supplying a tracer to a container of an apparatus for injecting the tracer, instantaneously injecting the tracer by controlling opening and closing of the container, and repeatedly performing these processes. The development of this apparatus has the advantage of making it possible to sequentially perform a tracer test by moving test equipment to a different depth within the well, without pulling up the test equipment after the tracer test is performed at a specific depth in the well. Therefore, time and work required for the tracer test are minimized.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for instantaneously injecting a tracer to a groundwater well, comprising:

a bi-directional piston with one end receiving a piston shaft moving up/down;

an upper plate connected to a lower end of the bi-directional piston;

a lower plate spaced apart from the upper plate at a predetermined distance to form a space and connected to the upper plate through a number of connection rods;

a container with one end fixedly connected to the piston shaft within the space and the other end being opened and hollow;

a tracer injection rod fixedly installed at the lower plate in a perpendicular direction to be operatively connected each other, and having one end forming a piston inserted into the other end of the container, wherein the tracer injection rod is hollow and comprises a number of release openings formed by boring on an outer circumferential surface of the tracer injection rod, so that the tracer supplied to a tracer injection pipe is released through the release openings;

the tracer injection pipe with both of upper and lower ends being opened, the upper end fixed to the upper plate and the lower end operatively connected to the lower plate; and a sensor attached to the outer circumferential surface of the tracer injection rod lengthwise, to check a concentration of the tracer released around the tracer injection rod so as to be compared with an initial concentration of the tracer being injected.

2. The apparatus of claim 1, wherein the container comprises: a number of guide rings formed to protrude from the outer circumferential surface of the container, to receive a number of the connection rods and to guide the container in a movement direction upon moving up/down.

3. The apparatus of claim 1, further comprising:

a tracer tank for storing the tracer;

an injection line with one end operatively connected to the tracer tank and the other end operatively connected to the tracer injection pipe; and a driving pump installed in the middle of the injection line, to pressurized the tracer to the tracer injection pipe so that the tracer is supplied to the tracer injection pipe.

4. The apparatus of claim 1, wherein, when the piston shaft is moved down by the bi-directional piston, the container receives the whole of the tracer injection rod lengthwise and the other opened end of the container is closely secured to the lower plate, and when the piston shaft is moved up by the bi-directional piston, the container moves up together with the piston shaft so that only the piston of the tracer injection rod is received in the other opened end of the container.

5. The apparatus of claim 1, wherein the lower plate comprises:

a connection groove formed on the top of the lower plate to correspond and fit with the other opened end of the container; and a packing ring insertedly installed in the connection groove, to maintain an airtight state at a connection region when the container moves down to be fitted into the connection groove.

6. The apparatus of claim 1, wherein the piston comprises an operative connection opening formed by boring and the container comprises an outlet opening formed on the top of the container, so that the pressure inside and outside the container is equally/consistently maintained even after the tracer is injected.

7. The apparatus of claim 1, wherein the bi-directional piston comprises a fixing ring on its top so that a fixing wire is connected to the fixing ring, and the fixing wire is controlled by a winch installed on a ground so that the apparatus is moved down to a desired target depth to be measured within an groundwater observation well.

8. The apparatus of claim 1, wherein the bi-directional piston has an upper end connected to one end of a first supply line and the lower end connected to one end of a second supply line, and the other ends of the first and second supply lines are connected to a pneumatic supply tank installed on the ground.

9. The apparatus of claim 1, wherein each of the upper and lower plates comprises a number of plates, auxiliary members are connected between a number of the upper plates and between a number of the lower plates, respectively, wherein the auxiliary member has a relatively greater diameter than those of the upper and lower plates and a number of the auxiliary members are face-joined in one body and include a number of cut parts formed at the equal intervals, along the circumference.

10. A method for instantaneously injecting a tracer for a groundwater well, the method comprising:

dropping an apparatus for instantaneously injecting the tracer for the groundwater well to an operator's desired depth to be measured within a groundwater observation well;

moving down a container to receive the whole of a tracer injection rod by supplying pressure to a first supply line of a bi-directional piston;

filling the tracer in the container by supplying the tracer to a tracer injection pipe and releasing the supplied tracer through a release opening of the tracer injection rod;

releasing the tracer outside by moving up the container by supplying the pressure to a second supply line of the bi-directional piston;

checking, for a predetermined time, the concentration of the released tracer, using a sensor positioned on an outer circumferential surface of the tracer injection rod; and determining whether to repeat measurement at the same depth within the groundwater observation well or to re-start measurement by changing a depth.

* * * * *